US012103642B2

(12) United States Patent
Jaziri et al.

(10) Patent No.: US 12,103,642 B2
(45) Date of Patent: Oct. 1, 2024

(54) MULTIHULL WATERCRAFT

(71) Applicant: BOMBARDIER RECREATIONAL PRODUCTS INC., Valcourt (CA)

(72) Inventors: Chadley Jaziri, Rockledge, FL (US); Rick Adamczyk, St. Cloud, FL (US); Bryan Umstattd, Palm Bay, FL (US)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 507 days.

(21) Appl. No.: 17/537,974

(22) Filed: Nov. 30, 2021

(65) Prior Publication Data

US 2022/0169339 A1 Jun. 2, 2022

Related U.S. Application Data

(60) Provisional application No. 63/119,474, filed on Nov. 30, 2020.

(51) Int. Cl.

| | |
|---|---|
| ***B63B 1/12*** | (2006.01) |
| ***B63B 1/18*** | (2006.01) |
| ***B63B 3/38*** | (2006.01) |
| ***B63B 3/48*** | (2006.01) |
| ***B63H 11/00*** | (2006.01) |

(52) U.S. Cl.

CPC ..... *B63B 1/125* (2013.01); *B63B 1/18* (2013.01); *B63B 3/38* (2013.01); *B63B 3/48* (2013.01); *B63H 11/00* (2013.01)

(58) Field of Classification Search

CPC .. B63B 1/00; B63B 1/042; B63B 1/10; B63B 1/125; B63B 1/16; B63B 1/18; B63B 1/22; B63B 1/28; B63B 3/38; B63B 3/48; B63B 39/061; B63H 11/00

USPC ..... 114/61.1, 271, 278, 284, 288; 440/38

See application file for complete search history.

(56) References Cited

U.S. PATENT DOCUMENTS

| | | | | |
|---|---|---|---|---|
| 4,606,291 | A * | 8/1986 | Hoppe | B63B 1/248 114/274 |
| 7,950,340 | B1 | 5/2011 | Curtis | |
| 8,186,291 | B1 | 5/2012 | Curtis | |
| 10,556,642 | B1 | 2/2020 | Massicotte et al. | |
| RE48,252 | E | 10/2020 | Curtis | |

OTHER PUBLICATIONS

Bennet Marine, Guide to Trim Tabs, Retrieved on Nov. 30, 2021; https://bennetttrimtabs.com/guide-to-trim-tabs/.

* cited by examiner

*Primary Examiner* — Daniel V Venne
(74) *Attorney, Agent, or Firm* — BCF LLP

(57) ABSTRACT

A multihull watercraft has at least three hulls extending longitudinally along the watercraft. The hulls at least partly define a port side tunnel and a starboard side tunnel therebetween. A port deflection device is configured to engage water in response to the watercraft leaning toward the port side when turning. The port deflection device is laterally aligned with the port side tunnel. A starboard deflection device is configured to engage water in response to the watercraft leaning toward the starboard side when turning. The starboard deflection device is laterally aligned with the starboard side tunnel. Each of the deflection devices includes an angled surface extending downwardly and rearwardly from an upper tunnel surface of a corresponding one of the tunnels. The angled surface is positioned to remain above a water line when the multihull watercraft is at rest on water.

22 Claims, 12 Drawing Sheets

MULTIHULL WATERCRAFT

CROSS-REFERENCE

The present application claims priority from U.S. Provisional Patent Application No. 63/119,474, filed on Nov. 30, 2020, the entirety of which is incorporated by reference herein.

FIELD OF TECHNOLOGY

The present technology relates to multihull watercraft.

BACKGROUND

Multihull watercraft are watercraft having multiple hulls and typically large size decks. For instance, tritoons are a type of boat having three hulls. Tritoons offer various benefits over monohull watercraft. For instance, their larger decks can accommodate a greater amount of equipment, furniture, and passengers. Tritoons also have greater stability as their three hulls distribute weight more evenly on the water. However, due to their configuration, tritoons may not offer the sporty riding style, in particular a more aggressive steering, that is desired by some users. This may be particularly true for instance for longer tritoons.

These problems are not necessarily limited to tritoons and can also apply to other multihull watercraft.

In view of the foregoing, there is a need for a multihull watercraft that addresses at least some of these drawbacks.

SUMMARY

It is an object of the present technology to ameliorate at least some of the inconveniences present in the prior art.

According to an aspect of the present technology, there is provided a multihull watercraft. The multihull watercraft includes: a deck; at least three hulls connected to the deck and extending longitudinally along the multihull watercraft, each of the at least three hulls having two outer lateral surfaces opposite one another, the at least three hulls at least partly defining a plurality of tunnels therebetween including a port side tunnel disposed closest to a port side of the multihull watercraft and a starboard side tunnel disposed closest to a starboard side of the multihull watercraft, each tunnel of the plurality of tunnels having a front end and a rear end, each tunnel of the plurality of tunnels being defined by: respective ones of the outer lateral surfaces of two of the at least three hulls; and an upper tunnel surface. The multihull watercraft also includes a port deflection device and a starboard deflection device. The port deflection device is configured to engage water in response to the multihull watercraft leaning toward the port side when turning, the port deflection device being laterally aligned with the port side tunnel and being disposed at one of: within the port side tunnel near the rear end thereof; and rearwardly of or at the rear end of the port side tunnel. The starboard deflection device is configured to engage water in response to the multihull watercraft leaning toward the starboard side when turning, the starboard deflection device being laterally aligned with the starboard side tunnel and disposed at one of: within the starboard side tunnel near the rear end thereof; and rearwardly of or at the rear end of the starboard side tunnel. Each of the port deflection device and the starboard deflection device includes an angled surface extending downwardly and rearwardly from the upper tunnel surface of a corresponding one of the tunnels, the angled surface being positioned to remain above a water line when the multihull watercraft is at rest on water.

In some embodiments, the multihull watercraft is a trihull watercraft. The at least three hulls include a port side hull, a starboard side hull, and a central hull disposed laterally between the port side hull and the starboard side hull. The port side tunnel is defined between the port side hull and the central hull. The starboard side tunnel is defined between the starboard side hull and the central hull.

In some embodiments, when the multihull watercraft is not turning, at least one of the at least three hulls extends vertically lower than other ones of the at least three hulls.

In some embodiments, when the multihull watercraft is not turning, the central hull has a keel that extends vertically lower than a lower end of each of the port side hull and the starboard side hull.

In some embodiments, the central hull has a greater volume than each of the port side hull and the starboard side hull.

In some embodiments, the central hull is more buoyant than each of the port side hull and the starboard side hull.

In some embodiments, for each of the port deflection device and the starboard deflection device: the angled surface extends at an inclination angle with respect to an adjacent portion of the upper tunnel surface defining the tunnel with which the deflection device is laterally aligned; and the inclination angle is greater than zero and less than 30°.

In some embodiments, for each of the port deflection device and the starboard deflection device, the inclination angle is approximately 15°.

In some embodiments, for each of the port deflection device and the starboard deflection device, the angled surface extends at an inclination angle with respect to an adjacent portion of the upper tunnel surface defining the tunnel with which the deflection device is laterally aligned; and the port deflection device and the starboard deflection device are adjustable to selectively set the inclination angle of the angled surface thereof.

In some embodiments, each of the port deflection device and the starboard deflection device is pivotally connected to at least one of: the deck; and at least one of the at least three hulls.

In some embodiments, the multihull watercraft also includes: at least one actuator operatively connected to the port deflection device and the starboard deflection device, the at least one actuator being configured to move the port deflection device and the starboard deflection device to set the inclination angle of the angled surface thereof; and a user input device in communication with the at least one actuator to control actuation thereof and thereby cause movement of the port deflection device and the starboard deflection device.

In some embodiments, the at least one actuator comprises a first actuator operatively connected to the port deflection device and a second actuator operatively connected to the starboard deflection device.

In some embodiments, the multihull watercraft is a tritoon; and the at least three hulls include a port side tube, a starboard side tube, and a central tube disposed laterally between the port side tube and the starboard side tube.

In some embodiments, each of the port deflection device and the starboard deflection device comprises a wedge-shaped body comprising the angled surface.

In some embodiments, the angled surface is substantially planar.

In some embodiments, the port deflection device and the starboard deflection device form in part a stern of the multihull watercraft.

In some embodiments, the multihull watercraft has a bow and a stern, a length of the multihull watercraft measured between the bow and the stern measuring between 8 feet and 35 feet inclusively.

In some embodiments, the multihull watercraft also includes at least one jet pump propulsion system for propelling the multihull watercraft, the jet pump propulsion system being supported by at least one of the at least three hulls.

In some embodiments, the multihull watercraft also includes a pair of trim tabs for providing hydrodynamic lift to the multihull watercraft when underway, the trim tabs being positioned vertically lower than the port and starboard deflection devices when the multihull watercraft is at rest.

In some embodiments, engagement of one of the port deflection device and the starboard deflection device with water when the watercraft leans to a corresponding one of the port side and the starboard side during turning causes the multihull watercraft to pitch forward and reduce a turning radius thereof toward the corresponding one of the port side and the starboard side.

In some embodiments, the upper tunnel surface is part of at least one of: the deck; and at least one of the at least three hulls.

According to another aspect of the present technology, there is provided a multihull watercraft. The multihull watercraft includes: a deck; a port side hull connected to the deck; a starboard side hull connected to the deck; and a central hull disposed connected to the deck and being disposed between the port side hull and the starboard side hull, the port side hull and the central hull defining a port side tunnel therebetween, the starboard side hull and the central hull defining a starboard side tunnel therebetween. The multihull watercraft also includes a port deflection device and a starboard deflection device. The port deflection device is configured to engage water in response to the multihull watercraft leaning toward the port side when turning, the port deflection device being laterally aligned with the port side tunnel and being disposed at one of: within the port side tunnel near a rear end of the port side tunnel; and rearwardly of or at the rear end of the port side tunnel. The starboard deflection device is configured to engage water in response to the multihull watercraft leaning toward the starboard side when turning, the starboard deflection device being laterally aligned with the starboard side tunnel and being disposed at one of: within the starboard side tunnel near a rear end of the starboard side tunnel; and rearwardly of or at the rear end of the starboard side tunnel. Each of the port deflection device and the starboard deflection device includes an angled surface extending downwardly and rearwardly from an upper tunnel surface of a corresponding one of the tunnels, the angled surface being positioned to remain above a water line when the multihull watercraft is at rest on water.

Embodiments of the present technology each have at least one of the above-mentioned objects and/or aspects, but do not necessarily have all of them. It should be understood that some aspects of the present technology that have resulted from attempting to attain the above-mentioned objects may not satisfy these objects and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
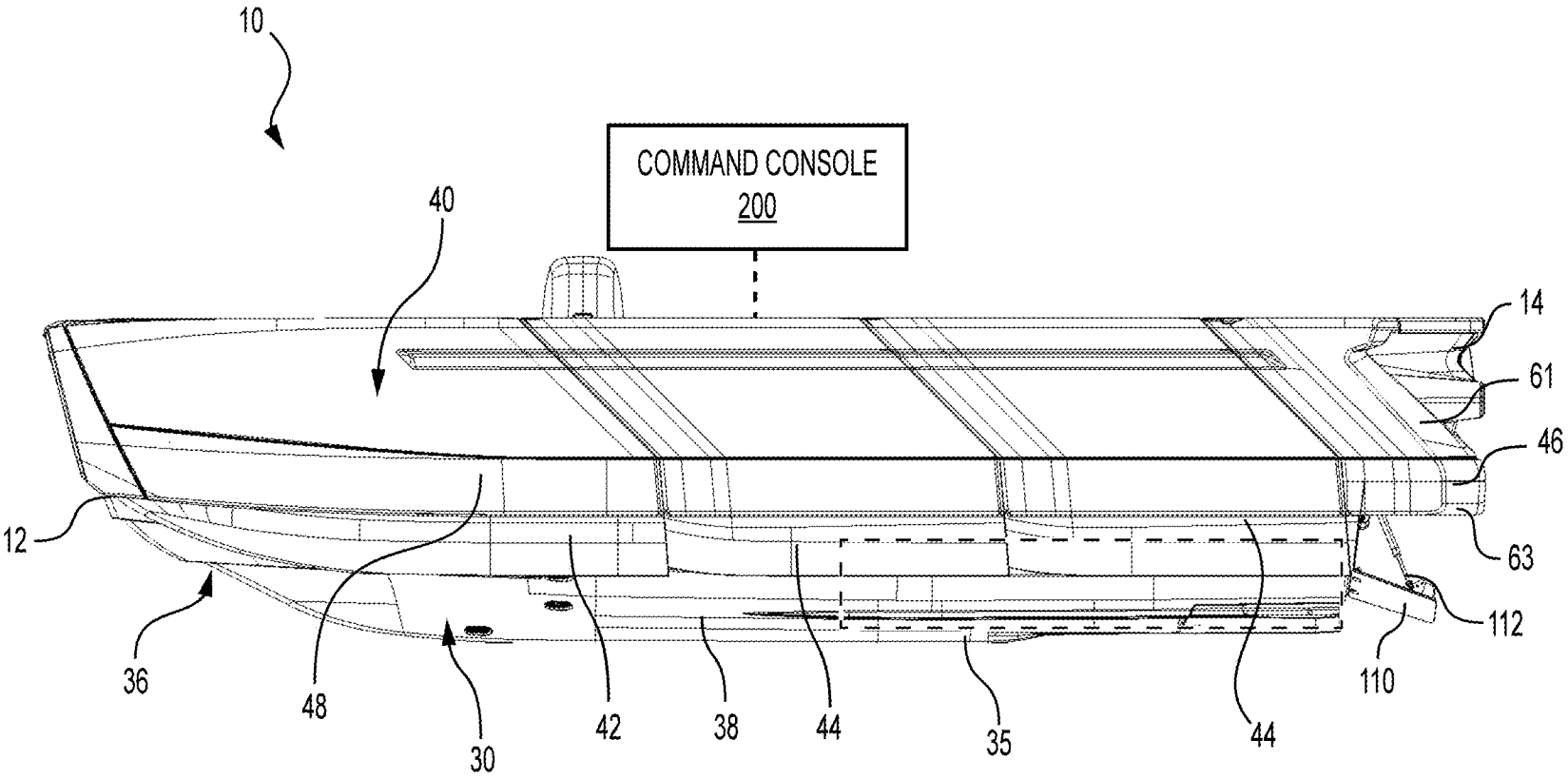
FIG. 1 is a left side elevation view of a boat in accordance with an embodiment of the present technology.

A boat 10 in accordance with an embodiment of the present technology is shown in FIGS. 1 to 6. As can be seen, the boat 10 has three hulls and is therefore a multihull watercraft, and particularly a tri-hull watercraft. In particular, the boat 10 is a tritoon and its hulls may thus be referred to as "toons" or "tubes". It is contemplated that the present technology can be implemented in other suitable types of multihull watercraft having at least three hulls. Furthermore, in this embodiment, the boat 10 has a length of approximately 16 feet, measured between a bow 12 and a stern 14 of the boat 10 (see FIG. 1). However, the boat 10 may have a different length in other embodiments. For instance, the length of the boat 10 may be anywhere between 8 feet and 35 feet inclusively.

Figure 4:
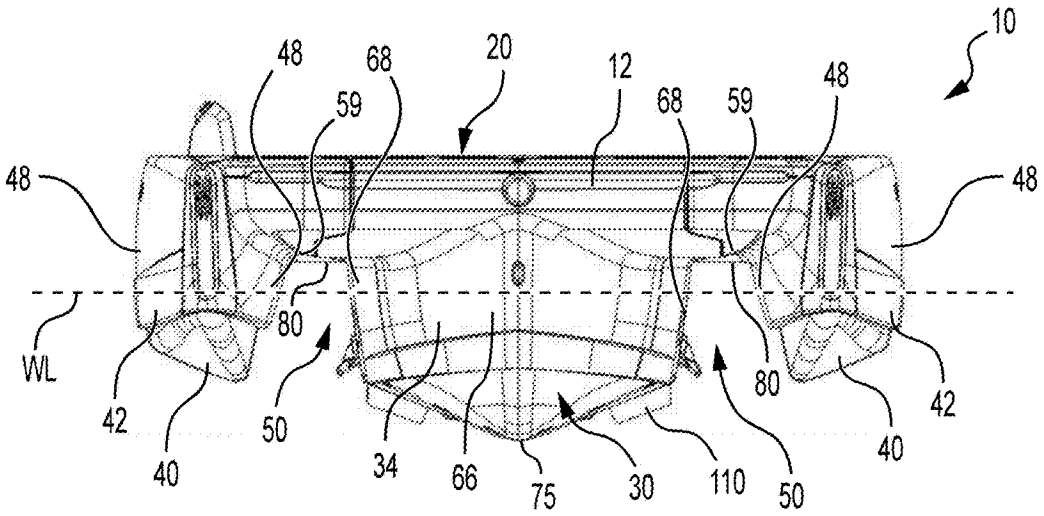
FIG. 4 is a front elevation view of the boat of FIG. 1, showing a water line when the boat is at rest (e.g., docked)
Figure 5:
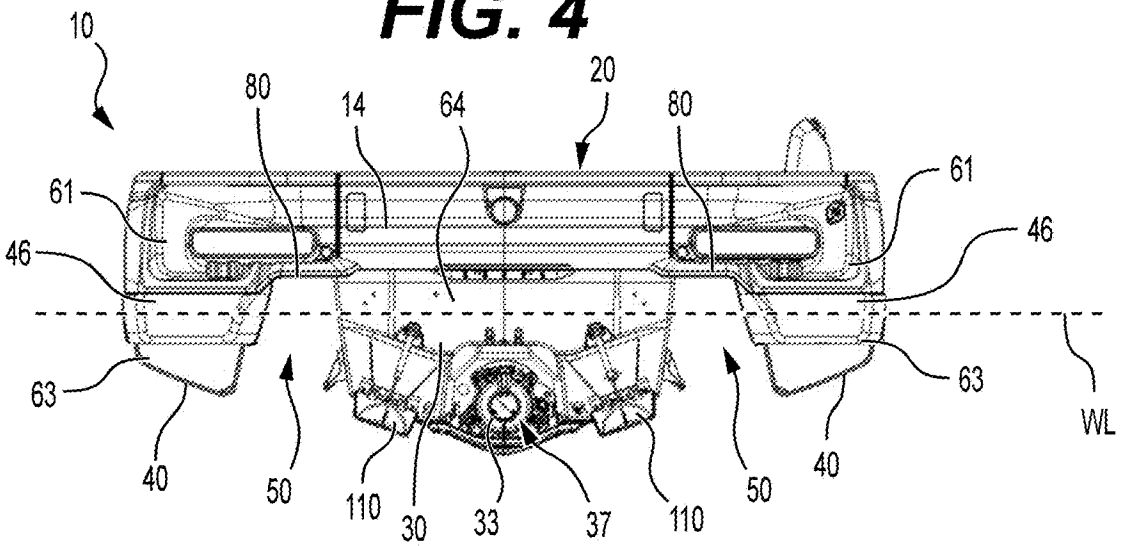
FIG. 5 is a rear elevation view of the boat of FIG. 1, showing the water line when the boat is at rest.
Figure 6:
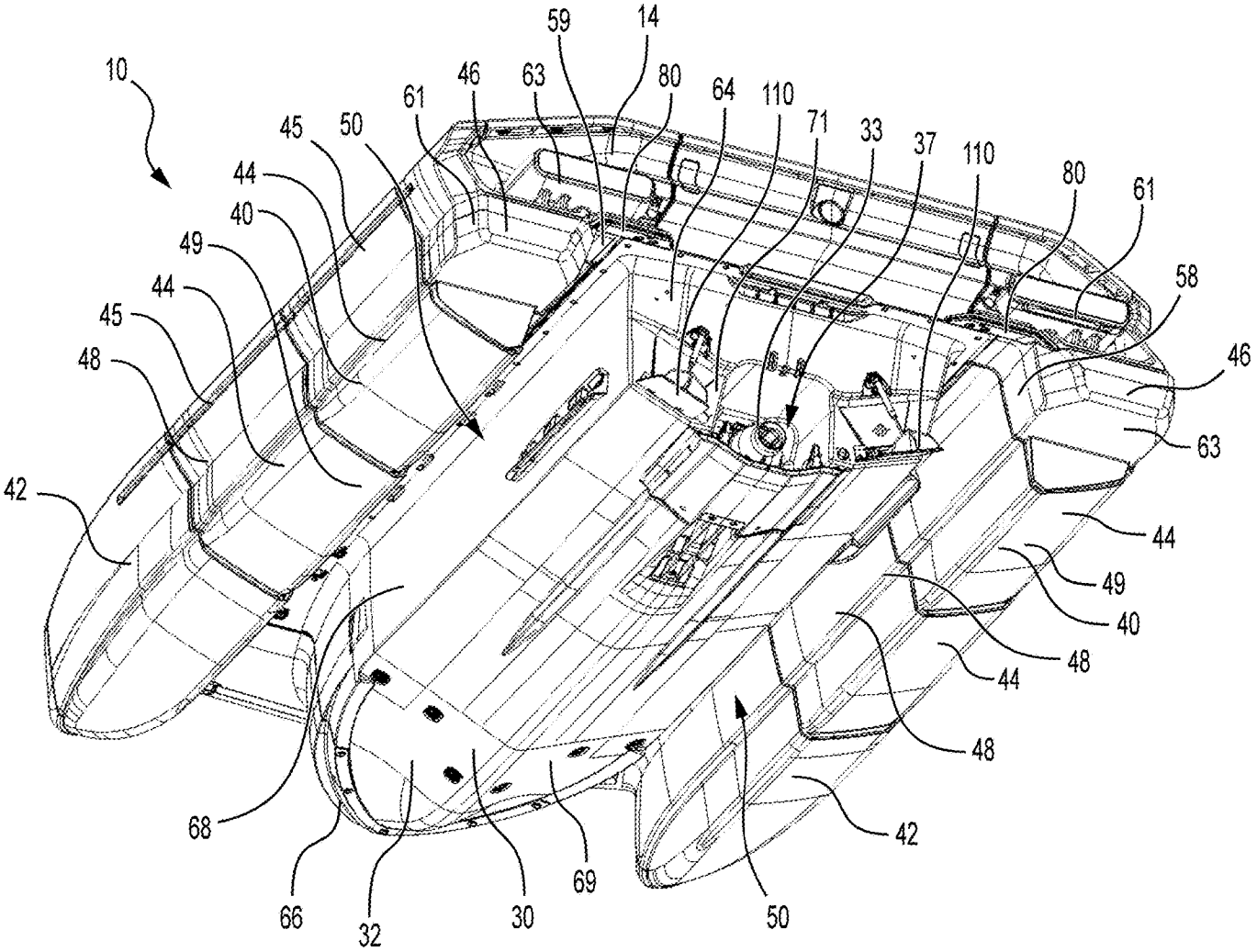
FIG. 6 is a perspective view, taken from a bottom, rear, left side, of the boat of FIG. 1.

With reference to FIGS. 4 to 6, the boat 10 has a central hull 30 and two lateral hulls 40, namely a port side hull 40 and a starboard side hull 40 (which may also be referred to as the left and right side hulls 40). The central hull 30 and the lateral hulls 40 extend longitudinally along the boat 10. The port and starboard side hulls 40 are laterally spaced apart from one another and are separated by the central hull 30 that is laterally centered therebetween and to which both the port and starboard side hulls 40 are connected. As such, in this embodiment, the boat 10 has three distinct hulls. It is contemplated that, in other embodiments, the boat 10 may have additional hulls.

Figure 3:
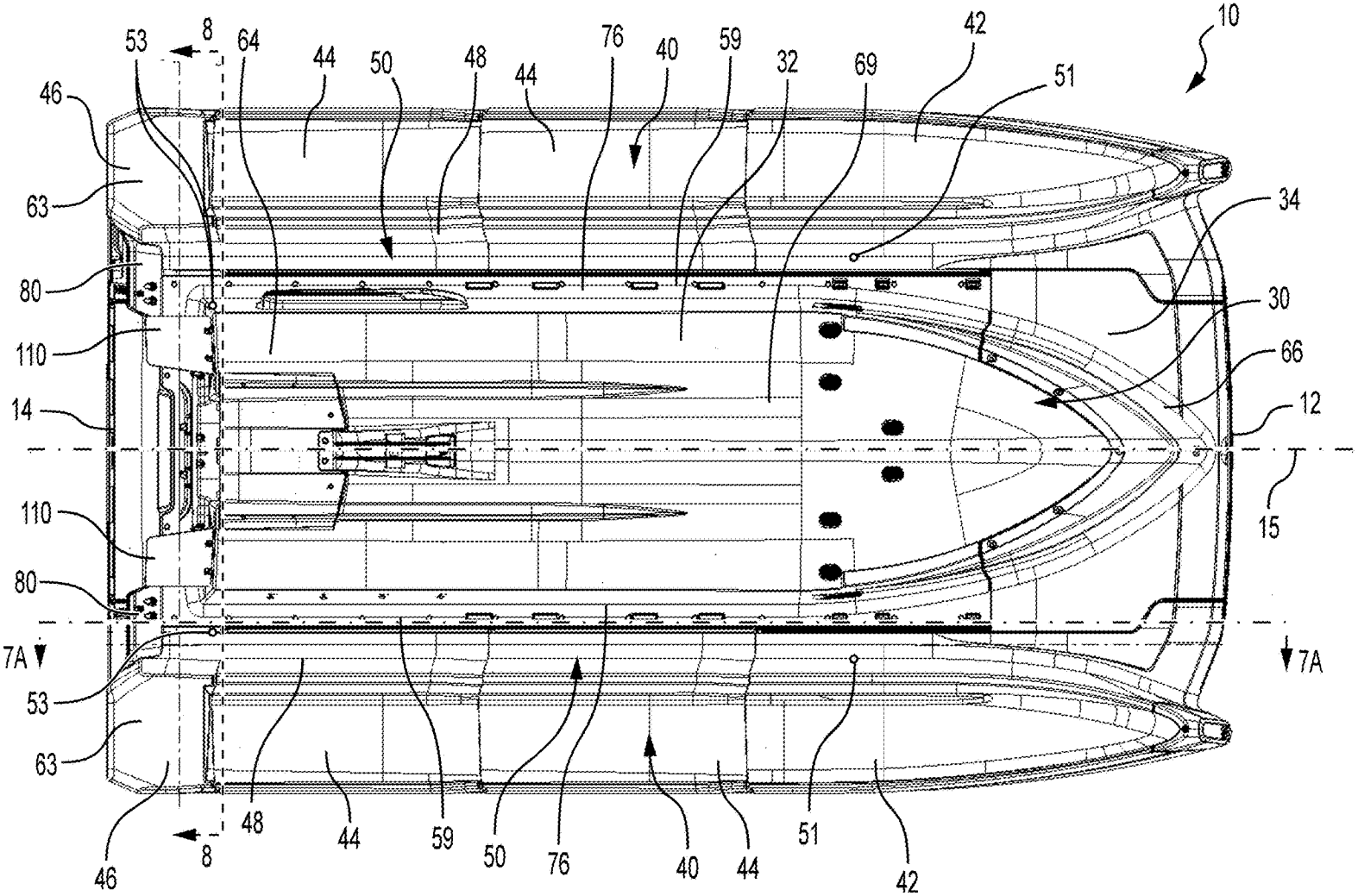
FIG. 3 is a bottom plan view of the boat of FIG. 1.

The central hull 30 and the port and starboard side hulls 40 define two tunnels 50 therebetween. As shown in FIG. 3, each tunnel 50 extends longitudinally along the boat 10 from a front tunnel end 51 to a rear tunnel end 53. Notably, a port side tunnel 50 is defined between the port side hull 40 and the central hull 30 and is closest to a port side of the boat 10, while a starboard side tunnel 50 is defined between the starboard side hull 40 and the central hull 30 and is closest to a starboard side of the boat 10. As such, as shown in FIG. 3, the port side tunnel 50 and the starboard side tunnel 50 are disposed on opposite sides of a longitudinal centerline 15 of the boat 10. In this embodiment, due to the shape of the hulls 30, 40, the tunnels 50 have a generally trapezoidal cross-sectional shape. The shape of the tunnels 50 may be different in other embodiments. For example, the shape of the tunnels 50 may be, but is in no way limited to, semi-circular, hour-glass shaped, rectangular, or triangular.

Figure 2:
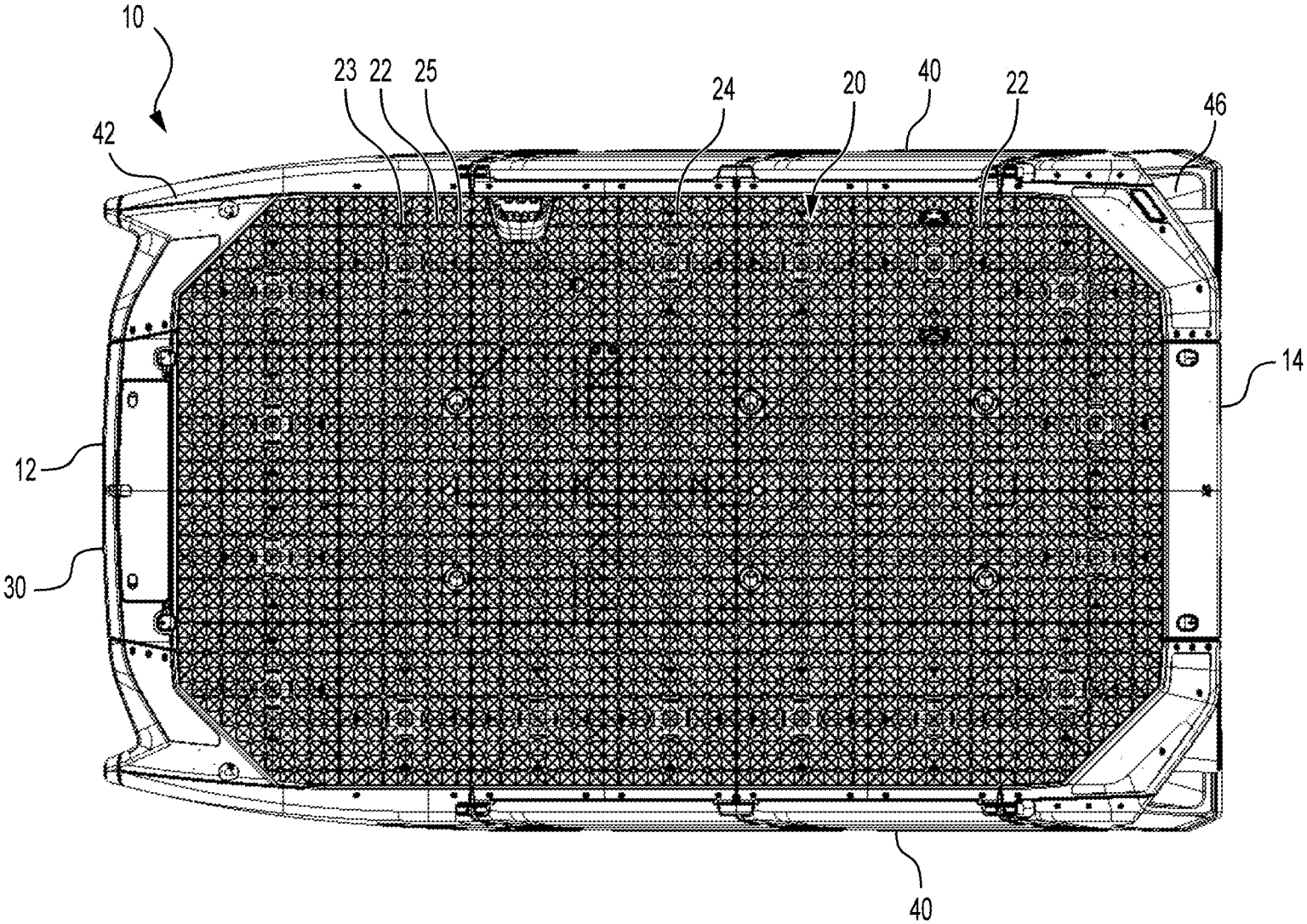
FIG. 2 is a top plan view of the boat of FIG. 1.

A deck 20 extends above the lateral hulls 40 and the central hull 30 and is supported thereby. As shown in FIG. 2, the deck 20 has an upper surface 24 for supporting occupants, as well as accessories and accommodations of the boat 10 (e.g., seating, storage, etc.) that are well known in the art and have been omitted for clarity. For instance, FIG. 1 shows a schematic illustration of a command console 200 supported by the deck 20 and includes vessel controls, such as steering and throttle controls, amongst others. In this embodiment, the deck 20 includes a plurality of tiles 22 which are configured for attachment of accessories thereto. The tiles 22 form a portion of the upper surface 24 of the deck 20. Notably, a number of the tiles 22 extend over the port side hull 40, some over the starboard side hull 40 and some others over the central hull 30.

The tiles 22 can have various shapes in accordance with their position on the deck 20. For instance, as can be seen in FIG. 2, some of the tiles 22 along the periphery of the deck 20 are triangular to conform to an angular shape of the periphery of the boat 10. In other cases, some of the tiles 22 are generally rectangular. Each of the tiles 22 has a gripping texture 25 formed on its upper surface 23. In this embodiment, the gripping texture 25 consists of a repeating triangular pattern. The gripping texture 25 may have a different pattern in other embodiments. A more detailed description of the configuration of the tiles 22 and the manner in which they are used for attachment of accessories can be found in U.S. patent application Ser. No. 16/887,481, filed May 29, 2020, the entirety of which is incorporated by reference herein.

It is contemplated that the deck 20 could have a different construction than that provided by the tiles 22. For instance, the deck 20 could have a more conventional construction such as including a metallic frame and an overlying flooring layer, such as fiberglass, wooden panels or plywood.

A power pack 35 (schematically illustrated in FIG. 1) of the boat 10, including a jet propulsion system 37 and a motor (not shown), is enclosed in part and supported by the central hull 30. The boat 10 is propelled by the jet propulsion system 37 powered by the motor. As best shown in FIGS. 5 and 6, the jet propulsion system 37 has a steering nozzle 33 used for steering the boat 10. A handlebar (not shown) is operatively connected to the steering nozzle 33. A throttle lever (not shown) is operatively connected to the motor for controlling operation of the motor. The handlebar and the throttle lever are located on a command console provided on the deck 20. The command console is not shown in the figures in order to properly show the upper surface 24 of the deck 20. It is contemplated that other propulsion systems, such as a stern drive or a marine outboard engine, may be used to propel the boat 10. It is also contemplated that the handlebar could be replaced by a steering wheel and that the steering nozzle 33 could be replaced by an outdrive or one or more rudders.

In this embodiment, the central hull 30 and the lateral hulls 40 of the boat 10 are constructed modularly so as to simplify the production and assembly of various length hulls based on common components. More specifically, the central hull 30 and the lateral hulls 40 of the boat 10 are assembled from a plurality of "modules", the number of which determines the length of each hull 30, 40. A detailed description of the construction of the central hull 30 and the lateral hulls 40 is provided, respectively, in U.S. patent application Ser. No. 17/039,625, and U.S. patent application Ser. No. 17/038,662, both filed on Sep. 30, 2020, the entirety of each of which is incorporated by reference herein. A brief description of the central hull 30 and lateral hulls 40 will thus be provided herein. It is contemplated that, in other embodiments, the central hull 30 and the lateral hulls 40 may not be constructed modularly but may instead each consist of one integral component.

With reference to FIGS. 3 and 6, in this embodiment, the central hull 30 includes a rear hull panel 64 and a front hull panel 66 that are connected one another to form the exterior surfaces of the central hull 30. In particular, together, the rear and front hull panels 64, 66 define two outer lateral surfaces 68 of the central hull 40 opposite one another (on either lateral side thereof) and a bottom surface 69 extending between the outer lateral surfaces 68. The outer lateral surfaces 68 define in part the port and starboard side tunnels 50. The central hull 40 has a keel 75 which, as can be seen FIG. 4, extends vertically lower than a lower end of each of the lateral hulls 40 when the boat 10 is not turning (i.e., not tilted to the port side or the starboard side of the boat 10). The keel 75 and shapes and relative positions of the bottom surface 69 and the lateral hulls 40, amongst other factors, allows the boat 10 to lean into turns when turning toward the port side or the starboard side. Moreover, the central hull 30 is dimensioned such that the central hull 30 has a greater volume than each of the port side hull 40 and the starboard side hull 40. The central hull 30 is also configured to be more buoyant than each of the port side hull 40 and the starboard side hull 40.

Figure 8:
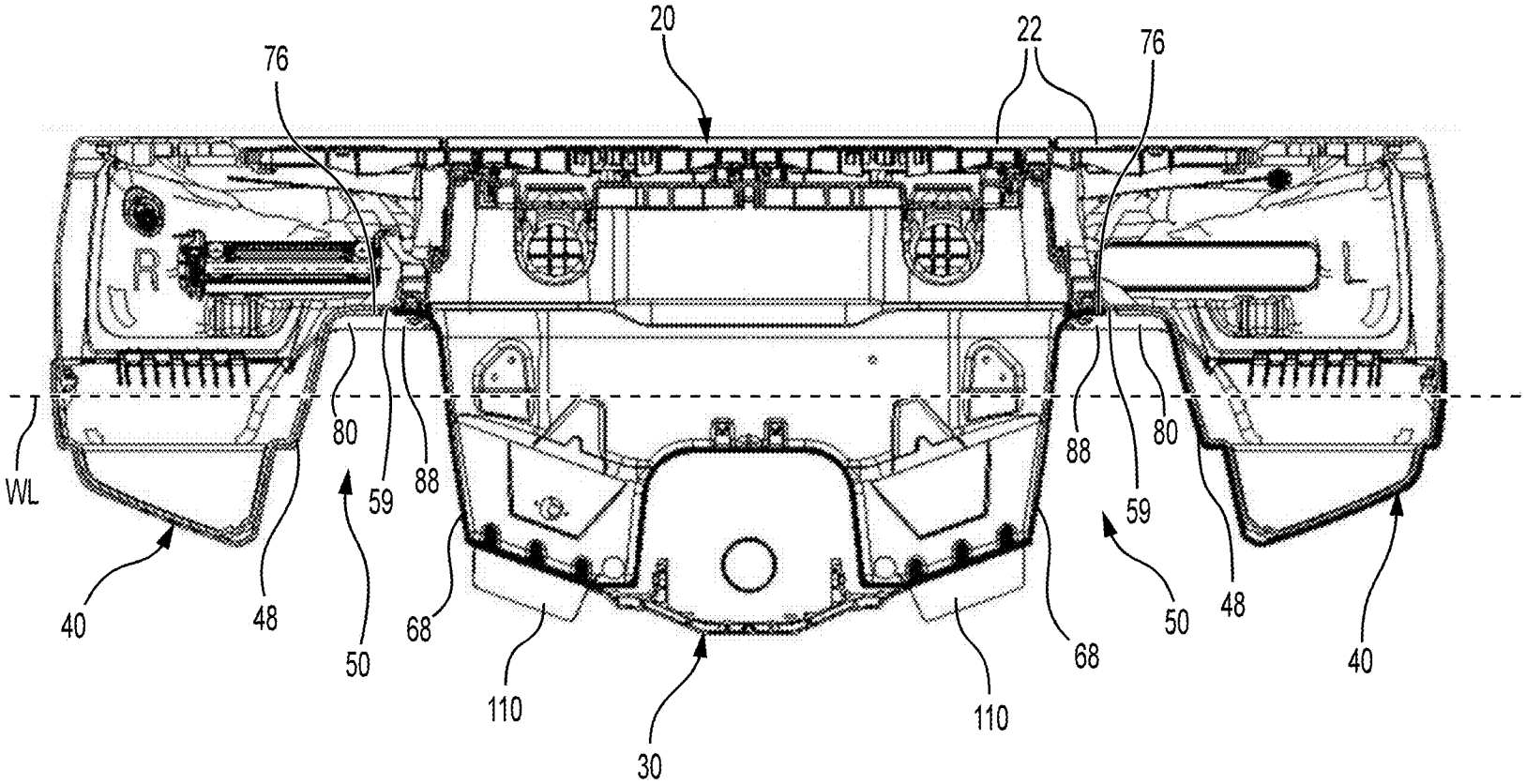
FIG. 8 is a cross-sectional view of the boat of FIG. 1 taken along line 8-8 in FIG. 3.
Figure 10:
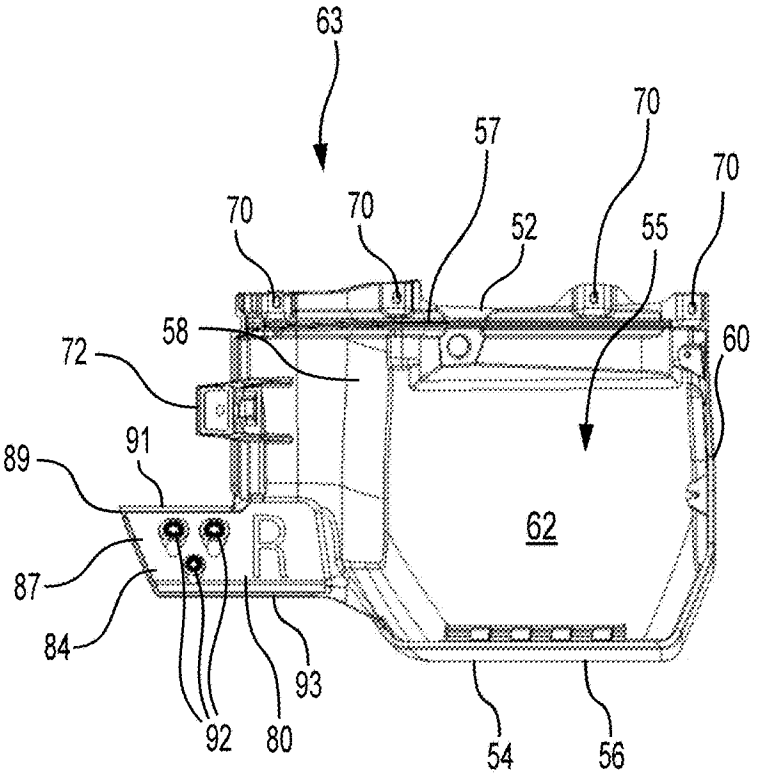
FIG. 10 is a top plan view of the rear hull panel of FIG. 9.
Figure 9:
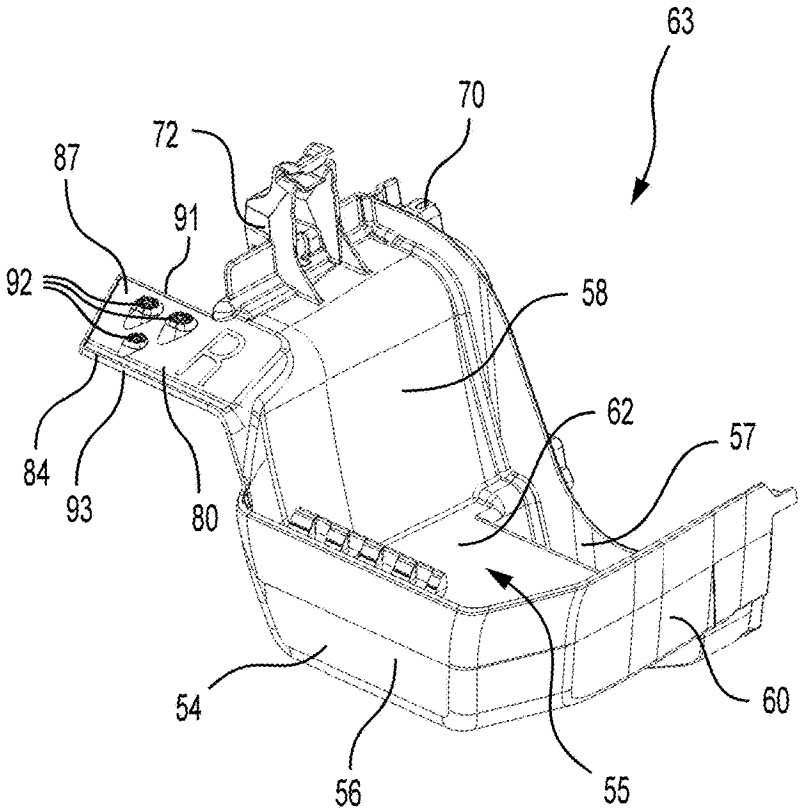
FIG. 9 is a perspective view, taken from a top, rear, right side, of a rear hull panel of a starboard side hull of the boat of FIG. 1.
Figure 12:
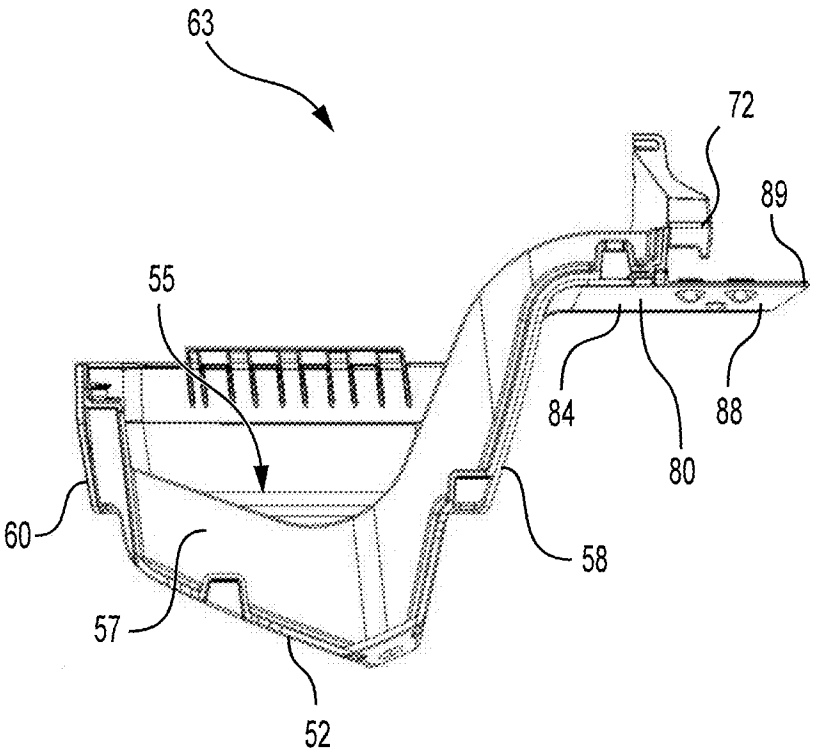
FIG. 12 is a front elevation view of the rear hull panel of FIG. 9.
Figure 11:
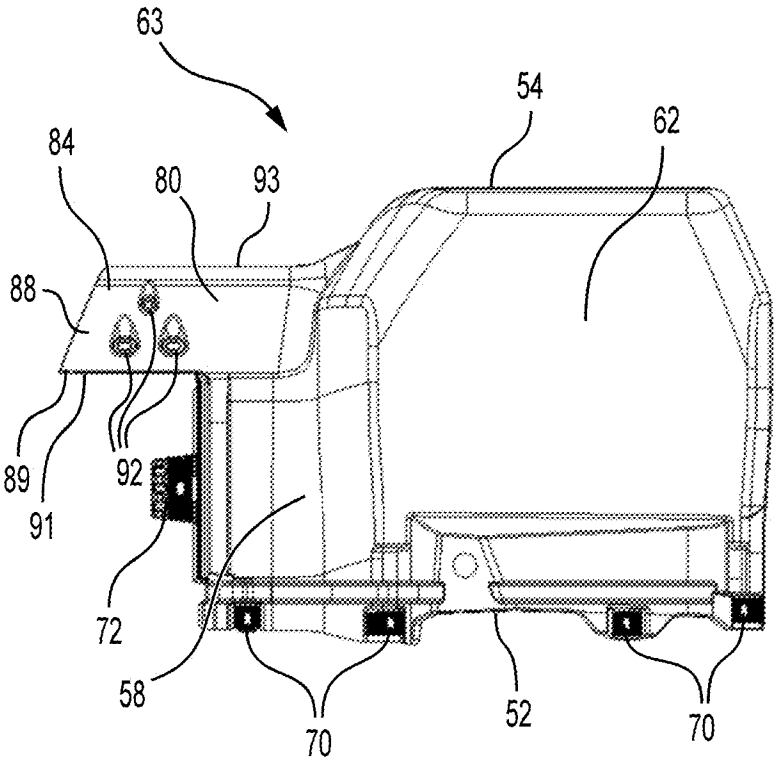
FIG. 11 is a bottom plan view of the rear hull panel of FIG. 9.

As best shown in FIGS. 1, 3 and 6, a pair of trim tabs 110 is pivotally connected to the central hull 30, namely to a rear surface 71 of the rear hull panel 64 near a lower end thereof. Trim tabs, such as the trim tabs 110 illustrated herein, are commonly used to extend the running surface of a boat, in particular the bottom surface 69 of the illustrated embodiment, and to provide hydrodynamic lift when underway (i.e., when the boat is being propelled forwardly). The trim tabs 110 are positioned proximate or near a water line WL when the boat 10 is on plane and, as can be seen in FIGS. 4, 5 and 8 (which show the water line WL when the boat is at rest (e.g., docked)), below the water line WL when the boat 10 is at rest or not on plane (i.e., when the weight of the boat 10 is predominantly supported by buoyancy 10 of the hulls 30, 40 rather than hydrodynamic lift). The water line WL is the line where the hulls 30, 40 meet the surface of the water. In practice, precisely where the water line sits with respect to the boat 10 will vary somewhat based on, inter alia, the number of passengers aboard and where they are located. Precisely where the water line sits will also vary somewhat from one boat 10 to another. Each trim tab 110 is connected to a respective trim tab adjuster 112 that is extendible to selectively pivot the corresponding trim tab 110 up or down about its pivot axis that extends generally laterally. As such, the angular orientation of the trim tabs 110 is adjustable to adjust a pitch attitude of the boat 10 while underway. The trim tab adjusters 112 may be manually operated by an operator or, alternatively, a trim tab control (not shown) operable by the operator of the boat 10 could be provided to control the trim tab adjusters 112. For instance, the trim tab control may be a switch provided on the command console 200 of the boat 10. It is contemplated that the trim tabs 110 could be omitted.

In this embodiment, the lateral hulls 40 are mirror images of one another about a vertical plane passing through the longitudinal centerline 15 of the boat 10 and therefore only one of the lateral hulls 40 will be described in detail herein. With reference to FIGS. 1 and 3, in this embodiment, the lateral hull 40 includes a front hull panel 42, two lower hull panels 44, two side hull panels 45 and a rear hull panel 46 that are connected to one another to form the exterior surfaces of the lateral hull 40. Notably, the lateral hull 40 has two opposite outer lateral surfaces 48 on either lateral side of the lateral hull 40 and a bottom surface 49 extending between the two outer lateral surfaces 48. The front and rear hull panels 42, 46 of the lateral hull 40 respectively define the front and rear ends thereof. The lower hull panels 44 and the side hull panels 45 are disposed between the front and rear hull panels 42, 46.

Figure 7A:
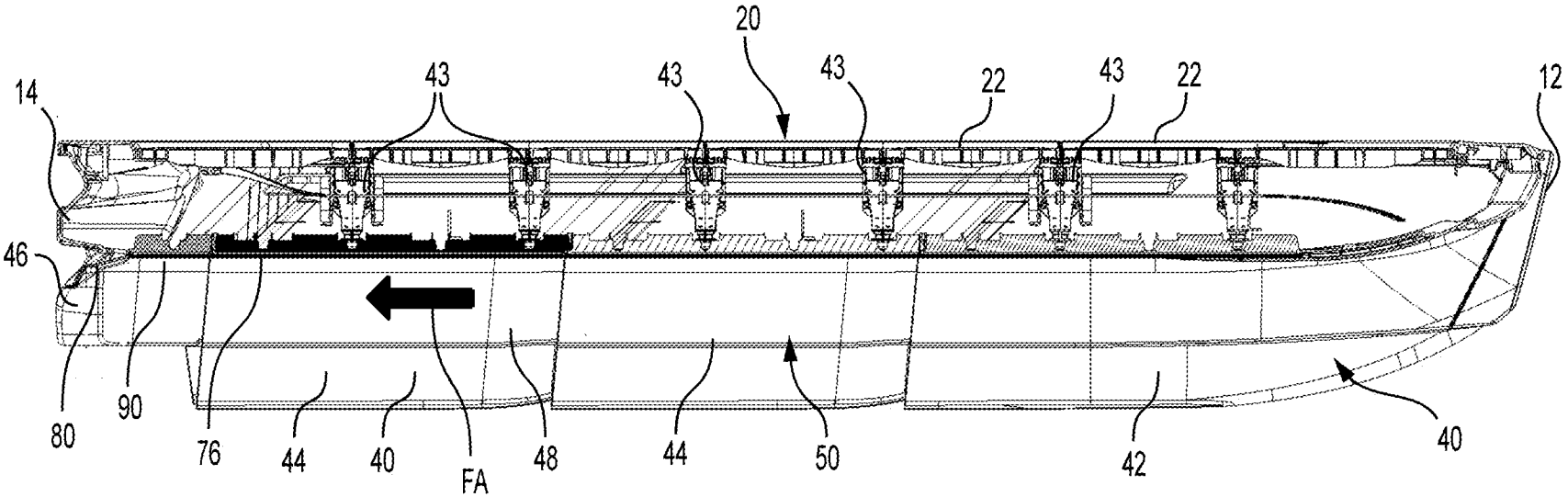
FIG. 7A is a cross-sectional view of the boat of FIG. 1 taken along line 7A-7A in FIG. 3, namely showing one of two deflection devices of the boat.

One of the two outer lateral surfaces 48 of the lateral hull 40, namely the outer lateral surface 48 facing laterally inwardly toward the longitudinal centerline 15, defines in part a corresponding one of the tunnels 50 of the boat 10. Moreover, in this embodiment, as shown in FIG. 4, the lateral hull 40 has an upper portion 59 that extends generally horizontally and laterally inwardly (toward the longitudinal centerline 15) from the upper edge of the inward facing outer lateral surface 48 to the upper edge of the facing outer lateral surface 68 of the central hull 30. The upper portion 59 of the lateral hull 40 has a lower surface 76 (FIG. 3) which defines in part a corresponding one of the tunnels 50. Notably, as shown in FIGS. 7A and 8, the lower surface 76 defines a top of the corresponding one of the tunnels 50. As such, the lower surface 76 will be referred to herein as the upper tunnel surface 76. In this embodiment the upper tunnel surface 76 is generally flat (i.e., planar), however it is contemplated that the upper tunnel surface 76 may be more substantially curved in other embodiments, for example curved transversely and/or longitudinally. It is also contemplated that the upper tunnel surface 76 need not be flat. Each tunnel 50 is thus defined by respective ones of the outer lateral surfaces 48, 68 of a lateral hull 40 and the central hull 30 and the upper tunnel surface 76. As partially shown in FIG. 7A, a plurality of braces 43 and buoyant elements (not shown) are disposed within the front hull panel 42, the lower hull panels 44 and the rear hull panel 46 to provide rigidity and buoyancy to the lateral hull 40.

While in this embodiment, the upper tunnel surface 76 is part of the lateral hull 40, it is contemplated that, in other embodiments, the upper tunnel surface 76 may be part of another part of the boat 10. For instance, in some embodiments, the upper tunnel surface 76 could be part of the central hull 30, or a combined part of each of the central hull 30 and one of the lateral hulls 40. The upper tunnel surface 76 could also be part of an underside of the deck 20 or a combined part of the underside of the deck 20 and one or more of the hulls 30, 40. For example, it is contemplated that the upper tunnel surface 76 could be defined by the deck including an exposed metallic frame beneath an overlying flooring layer. In yet other embodiments, the upper tunnel surface 76 could be defined by a separate component that is not part of the hulls 30, 40 or the deck 20.

Figure 13:
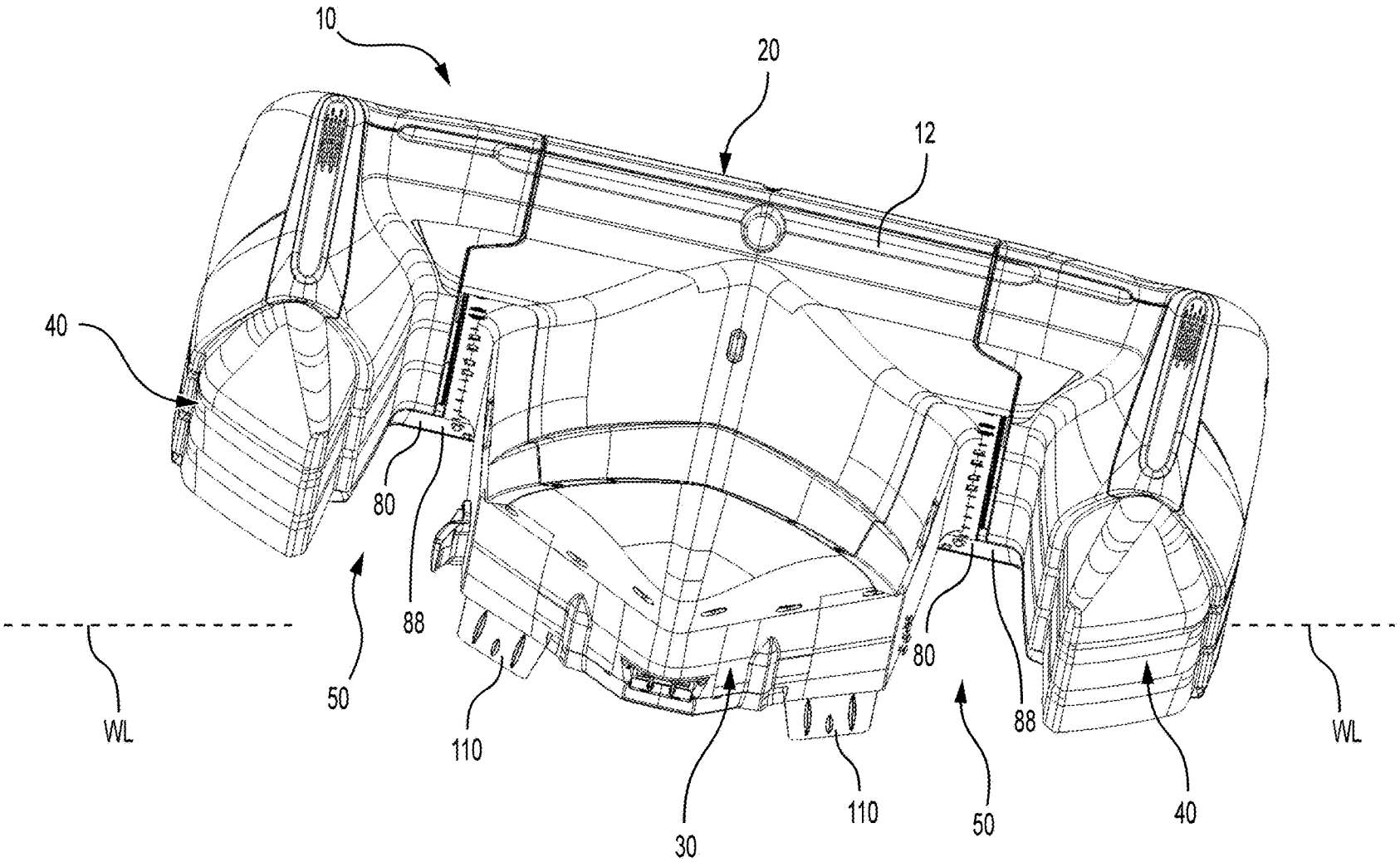
FIG. 13 is a front elevation view of the boat of FIG. 1, showing the boat leaning toward a port side when turning.

As shown in FIGS. 3 to 6, the port side hull 40 and the starboard side hull 40 have port and starboard deflection devices 80 respectively for facilitating turning of the boat 10. As shown in FIG. 13, the boat 10 will lean port when making a port side turn. When the boat 10 makes such a port side turn, water splash within the port side tunnel 50, in particular water displaced by the central hull 30, will engage the port deflection device 80 in response to the boat 10 leaning toward the port side when turning. Similarly, the starboard deflection device 80 is configured to engage water in the starboard side tunnel 50 in response to the boat 10 leaning toward the starboard side when turning. For reference, the water line WL illustrated in FIG. 13 represents the surface of the water surrounding the boat 10 when the boat 10 is turning toward the port side. As will be explained in greater detail below, in use, the port and starboard deflection devices 80 can help reduce a turning radius of the boat 10.

As best shown in FIG. 8, the port and starboard deflection devices 80 are laterally aligned with the port and starboard side tunnels 50 respectively. Moreover, the port and starboard deflection devices 80 are disposed closer to the rear end 53 of the corresponding one of the tunnels 50 than to the front end 51 thereof. In particular, the port and starboard deflection devices 80 are disposed near the rear end 53 of the corresponding one of the tunnels 50 (i.e., close to or at the rear end 53). The term "near" used in reference to the positioning of the deflection devices 80 relative to the rear ends 53 of the tunnels 50 is defined herein as the deflection devices 80 being positioned, along the longitudinal direction of the boat 10, relative to the rear end 53 of the corresponding tunnel 50 within a distance corresponding to 25% of the length of the corresponding tunnel 50 (measured from the front end 51 to the rear end 53 thereof). In this embodiment, the port and starboard deflection devices 80 are disposed rearwardly of the rear end 53 of the corresponding one of the tunnels 50, near to the rear end 53. It is contemplated that, in other embodiments, the port and starboard deflection devices 80 may be disposed at the rear end 53 of the corresponding one of the tunnels 50 or within the corresponding one of the tunnels 50 near to the rear end 53 (i.e., forwardly of and near the rear end 53).

It should be noted that providing the port and starboard deflection devices 80 in lateral alignment with the tunnels 50 goes against conventional knowledge of keeping the tunnels 50 as clear as possible in order to minimize drag when the boat 10 is underway.

Figure 7B:
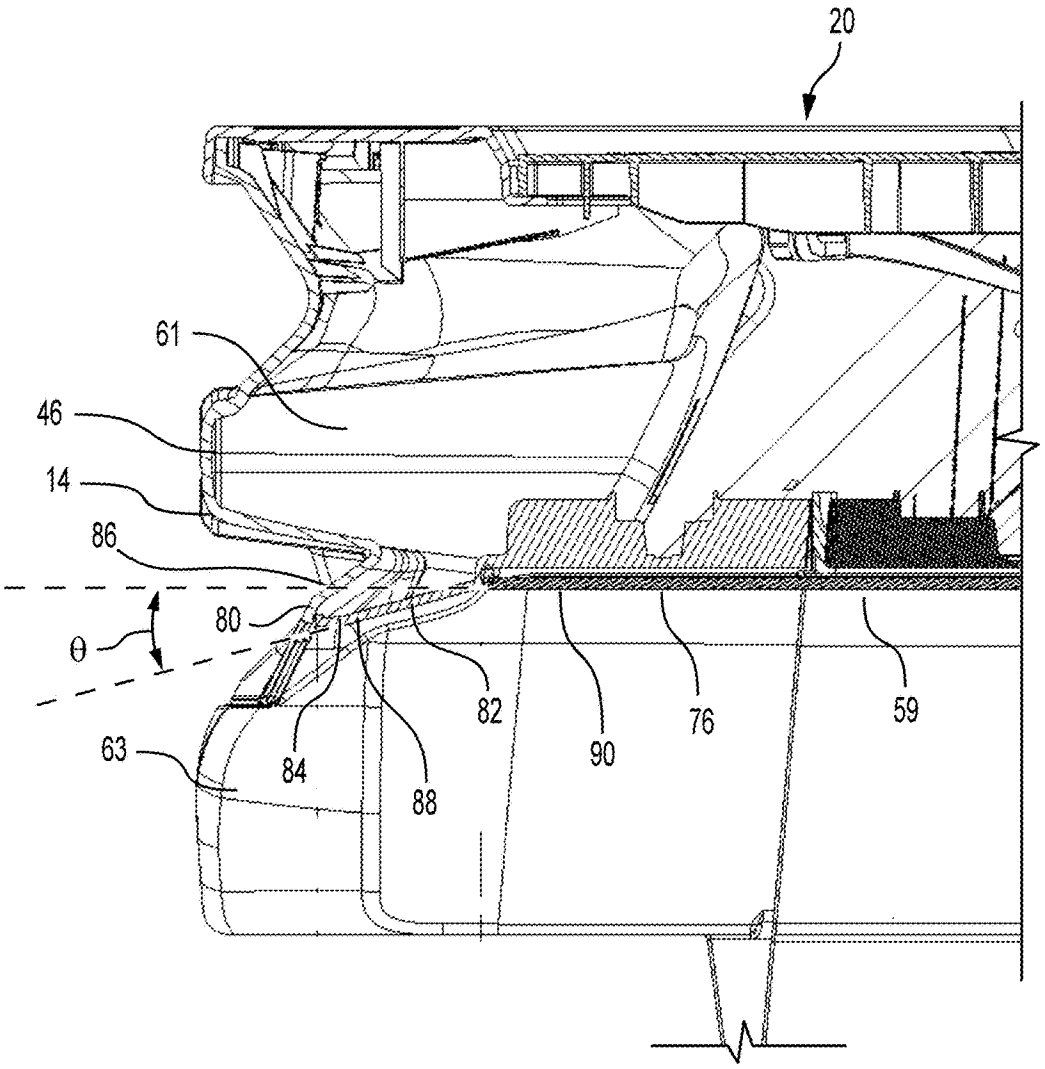
FIG. 7B is a detailed view of part of the cross-section of FIG. 7A.

In this embodiment, the rear hull panel 46 of each of the port and starboard side hulls 40 comprises the corresponding deflection device 80. Notably, the port and starboard deflection devices 80 form in part the stern 14 of the boat 10. As shown in FIG. 7B, in this embodiment, the deflection device 80 of each of the lateral hulls 40 has a body 82 that is generally wedge-shaped. Notably, the body 82 has a lower wall 84 that extends downwardly and rearwardly from the upper tunnel surface 76 of the corresponding one of the tunnels 50, and a rear wall 86 which extends upwardly and forwardly from the lower end of the lower wall 84. The lower wall 84 has a lower angled surface 88 which, like the lower wall 84, extends downwardly and rearwardly from the upper tunnel surface 76 of the corresponding one of the tunnels 50. The angled surface 88 is substantially planar such that a majority of the angled surface 88 lies along a common plane. As shown in FIG. 8, the angled surface 88 is positioned to remain above the water line WL when the boat 10 is at rest on water (i.e., not moving on water). That is unlike conventional trim tabs, such as the trim tabs 110 which, when the boat 10 is at rest, are positioned vertically lower than the port and starboard deflection devices 80 and, more particularly, are positioned below the water line WL.

With reference to FIG. 7B, the angled surface 88 extends at an inclination angle θ with respect to an adjacent portion 90 of the upper tunnel surface 76 defining the tunnel 50 with which the deflection device 80 is laterally aligned. The inclination angle θ may vary in different embodiments. For instance, the inclination angle θ may be greater than zero and less than 30°. In this embodiment, the inclination angle θ is approximately 15°. As will be described in more detail below, it is contemplated that the inclination angle θ may be adjustable to selectively set the inclination angle θ.

The inclination angle θ of the port angled surface 88 (i.e., the angled surface 88 of the port deflection device 80) deflects water flow FA (FIG. 7A) when the boat 10 is underway and is leaning into a port side turn and the same is true of the starboard angled surface 88 (i.e., the angled surface 88 of the starboard deflection device 80) when the boat is leaning into a starboard side turn. More specifically, the port and starboard deflection devices 80 are positioned near the rear ends 53 of the tunnels 50 such that the engagement of the port deflection device 80 or the starboard deflection device 80 with water sprayed within the respective tunnel 50 when the boat 10 leans to the port side or the starboard side respectively during turning may increase drag on that side and thereby cause the boat 10 to pitch forward, forcing the bow 12 downwards, for greater turn initiation. Notably, this allows a front part of the boat 10 to "grab" onto the water and thereby reduces a turning radius of the boat 10 toward the corresponding one of the port side and the starboard side. Therefore, the deflection devices 80 can help in facilitating turning of the boat 10, namely providing more aggressive turning than would otherwise possible without the deflection devices 80. The inclination angle θ, as well as the length and position of the angled surface 88, can be designed for the particular configuration of the boat 10 in order to provide desired turning characteristics. Furthermore, the angled surface 88 can also provide additional lift to the boat 10 at low speed, such as when the boat 10 is getting on plane.

As shown in FIG. 7B, in this embodiment, each deflection device 80 is comprised in part by an upper portion 61 and in part by a lower portion 63 of the corresponding rear hull panel 46. The upper portion 61 and the lower portion 63 are connected to one another to form the rear hull panel 46. In particular, the upper portion 61 comprises the rear wall 86 of the deflection device 80 while the lower portion 63 comprises the lower wall 84. In this embodiment, the lower wall 84 and the upper wall 86 are connected to one another by three bolts (not shown) that are inserted through respective openings 92 defined by the lower wall 84 and are received by respective nuts (not shown) that are fixed to the upper wall 86. The intersection of the lower wall 84 and the rear wall 86 may be sealed. The lower portion 63 of the rear hull panel 46, and the lower wall 84 comprised thereby, will be described herein with reference to FIGS. 9 to 12 which illustrate the lower portion 63 of the rear hull panel 46 of the starboard side hull 40 and therefore the lower wall 84 of the starboard deflection device 80. It is to be understood that port deflection device 80 and the lower portion 63 of the rear hull panel 46 of the port side hull 40 are a mirror image thereof.

The lower portion 63 of the rear hull panel 46 has a front end 52 and a rear end 54 opposite the front end 52. The lower portion 63 of the rear hull panel 46 has a rear wall 56 defining the rear end 54, a front wall 57, an inner lateral wall 58, an outer lateral wall 60 opposite the inner lateral wall 58, and a bottom wall 62. Four lower connecting flanges 70 are disposed along the front end 52 for connecting the lower portion 63 of the rear hull panel 46 to the lower hull panel 44 forwardly adjacent thereto. The lower portion 63 of the rear hull panel 46 also has an interlocking portion 72 configured to be interlocked with a lateral brace element (not shown) extending within the central hull 30. The rear hull panel 46 is concave, namely defining a hollow space 55 between the walls 56, 58, 60, 62 in order to receive a buoyant element therein.

As can be seen, the lower wall 84 of the deflection device 80 is disposed at an upper end of the lower portion 63 of the rear hull panel 46, specifically at an intersection between the rear wall 56 and the inner lateral wall 58. The lower wall 84 is disposed at an angle relative to the bottom wall 62 of the rear hull panel 46. An upper surface 87 of the lower wall 84 faces upwardly toward the upper portion 61 of the rear hull panel 46. A laterally innermost end 89 of the lower wall 84 corresponds to an inner lateral end of the rear hull panel 46. In this embodiment, a length of the lower wall 84, measured from its upper end 91 to its lower end 93, is approximately 100 mm (4 inches).

In this embodiment, the lower wall 84 is made integrally with the lower portion 63 of the rear hull panel 46 and, similarly, the rear wall 86 is made integrally with the upper portion 61 of the rear hull panel 46. In other embodiments, the deflection device 80 may be made integrally with the adjacent portion 90 of the upper tunnel surface 76. It is contemplated that, in yet other embodiments, the deflection device 80 may be a separate component that is connected to the rear hull panel 46. For instance, in some embodiments, the deflection device 80 may be fastened to the rear hull panel 46 (e.g., with fasteners). Moreover, it is contemplated that, in some embodiments, the deflection device 80 can be removably connected to the boat 10 in order to replace the deflection device 80 with another deflection device 80 whose lower wall 84 is configured to define a different inclination angle θ.

Figure 14:
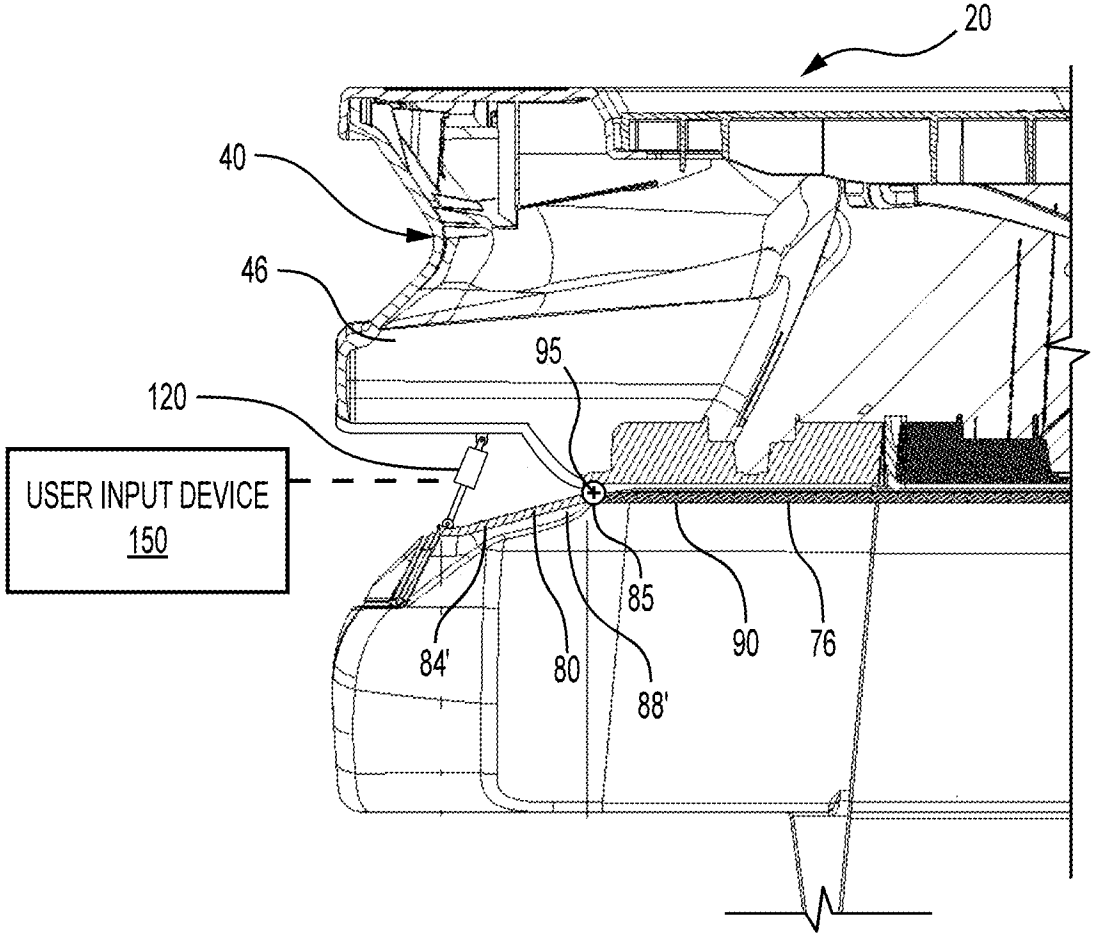
FIG. 14 is a cross-sectional view of part of the boat in accordance with an alternative embodiment in which the deflection devices of the boat are adjustable.

In an alternative embodiment, with reference to FIG. 14, the inclination angle θ of the angled surface 88 of the deflection devices 80 is adjustable to allow the operator to selectively set the inclination angle θ within a range (e.g., 0° to 30° inclusively). More particularly, in this alternative embodiment, each of the port and starboard deflection devices 80 has a deflecting wall member 84' which has the same shape as the lower wall 84 described above and has an angled surface 88' on its lower side. The deflecting wall member 84' is pivotable relative to the upper tunnel surface 76 of the corresponding tunnel 50. In particular, the deflecting wall member 84' is pivotably connected by a pivot 85 to the deck 20 and/or to either or both of the lateral hull 40 defining the corresponding tunnel 50 and the central hull 30. The pivot 85 defines a pivot axis 95 extending generally laterally. Two deflection device adjusters 120 are provided, each being connected to a corresponding one of the deflection devices 80. Each deflection device adjuster 120 is connected between the deflecting wall member 84' and a corresponding one of the lateral hulls 40. It is contemplated that the deflection device adjuster 120 could be connected to the central hull 30, or the underside of the deck 20. The deflection device adjusters 120 are extendible so as to pivot the deflection devices 80 about their respective axes 95 and thereby selective set the inclination angle θ of the angled surface 88'. In this example, the deflection device adjusters 120 are actuators configured to move the port and starboard deflection devices 80 to the set their respective inclination angles θ. Notably, each deflection device adjuster 120 is in communication with a user input device 150 which controls the deflection device adjuster 120 to thereby cause movement of the corresponding one of the port and starboard deflection devices 80. It is contemplated that the deflection device adjusters 120 could instead be manually operated by the operator, namely adjusting the length of the deflection device adjusters 120 to set the port and starboard inclination angles θ.

Allowing the operator to set the inclination angle θ enables the operator to adjust the effect of the deflection devices 80 in the steering behavior of the boat 10, namely allowing the user to determine how aggressively the boat 10 will turn in accordance with the operator's desired riding style. Furthermore, controlling the inclination angles θ of the port and starboard deflection devices 80 separately may also allow the operator to correct for an unbalanced loading of the boat 10. For instance, if loads are distributed unequally on the boat 10 (e.g., furniture, equipment, passengers, etc.), the boat 10 can tend to list toward a particular side and/or to steer unevenly. This may be corrected by setting the inclinations angles θ of the port and starboard deflection devices 80 to different values.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A multihull watercraft, comprising:
a deck;
at least three hulls connected to the deck and extending longitudinally along the multihull watercraft, each of the at least three hulls having two outer lateral surfaces opposite one another, the at least three hulls at least partly defining a plurality of tunnels therebetween including:
a port side tunnel disposed closest to a port side of the multihull watercraft; and
a starboard side tunnel disposed closest to a starboard side of the multihull watercraft,
each tunnel of the plurality of tunnels having a front end and a rear end, each tunnel of the plurality of tunnels being defined by:
respective ones of the outer lateral surfaces of two of the at least three hulls; and
an upper tunnel surface;
a port deflection device configured to engage water in response to the multihull watercraft leaning toward the port side when turning, the port deflection device being laterally aligned with the port side tunnel and being disposed at one of:
within the port side tunnel near the rear end thereof; and
rearwardly of or at the rear end of the port side tunnel; and
a starboard deflection device configured to engage water in response to the multihull watercraft leaning toward the starboard side when turning, the starboard deflection device being laterally aligned with the starboard side tunnel and disposed at one of:
within the starboard side tunnel near the rear end thereof; and
rearwardly of or at the rear end of the starboard side tunnel,
each of the port deflection device and the starboard deflection device comprising:
an angled surface extending downwardly and rearwardly from the upper tunnel surface of a corresponding one of the tunnels, the angled surface being positioned to remain above a water line when the multihull watercraft is at rest on water.

2. The multihull watercraft of claim 1, wherein:
the multihull watercraft is a tri-hull watercraft;
the at least three hulls include a port side hull, a starboard side hull, and a central hull disposed laterally between the port side hull and the starboard side hull;
the port side tunnel is defined between the port side hull and the central hull; and
the starboard side tunnel is defined between the starboard side hull and the central hull.

3. The multihull watercraft of claim 1, wherein, when the multihull watercraft is not turning, at least one of the at least three hulls extends vertically lower than other ones of the at least three hulls.

4. The multihull watercraft of claim 2, wherein, when the multihull watercraft is not turning, the central hull has a keel that extends vertically lower than a lower end of each of the port side hull and the starboard side hull.

5. The multihull watercraft of claim 2, wherein the central hull has a greater volume than each of the port side hull and the starboard side hull.

6. The multihull watercraft of claim 2, wherein the central hull is more buoyant than each of the port side hull and the starboard side hull.

7. The multihull watercraft of claim 1, wherein, for each of the port deflection device and the starboard deflection device:
the angled surface extends at an inclination angle with respect to an adjacent portion of the upper tunnel surface defining the tunnel with which the deflection device is laterally aligned; and
the inclination angle is greater than zero and less than 30°.

8. The multihull watercraft of claim 7, wherein, for each of the port deflection device and the starboard deflection device, the inclination angle is approximately 15°.

9. The multihull watercraft of claim 1, wherein:
for each of the port deflection device and the starboard deflection device, the angled surface extends at an inclination angle with respect to an adjacent portion of the upper tunnel surface defining the tunnel with which the deflection device is laterally aligned; and
the port deflection device and the starboard deflection device are adjustable to selectively set the inclination angle of the angled surface thereof.

10. The multihull watercraft of claim 1, wherein each of the port deflection device and the starboard deflection device is pivotally connected to at least one of:
the deck; and
at least one of the at least three hulls.

11. The multihull watercraft of claim 9, further comprising:
at least one actuator operatively connected to the port deflection device and the starboard deflection device, the at least one actuator being configured to move the port deflection device and the starboard deflection device to set the inclination angle of the angled surface thereof; and a user input device in communication with the at least one actuator to control actuation thereof and thereby cause movement of the port deflection device and the starboard deflection device.

12. The multihull watercraft of claim 11, wherein the at least one actuator comprises a first actuator operatively connected to the port deflection device and a second actuator operatively connected to the starboard deflection device.

13. The multihull watercraft of claim 1, wherein:

the multihull watercraft is a tritoon; and the at least three hulls include a port side tube, a starboard side tube, and a central tube disposed laterally between the port side tube and the starboard side tube.

14. The multihull watercraft of claim 1, wherein each of the port deflection device and the starboard deflection device comprises a wedge-shaped body comprising the angled surface.

15. The multihull watercraft of claim 1, wherein the angled surface is substantially planar.

16. The multihull watercraft of claim 1, wherein the port deflection device and the starboard deflection device form in part a stern of the multihull watercraft.

17. The multihull watercraft of claim 1, wherein the multihull watercraft has a bow and a stern, a length of the multihull watercraft measured between the bow and the stern measuring between 8 feet and 35 feet inclusively.

18. The multihull watercraft of claim 1, further comprising at least one jet pump propulsion system for propelling the multihull watercraft, the jet pump propulsion system being supported by at least one of the at least three hulls.

19. The multihull watercraft of claim 1, further comprising a pair of trim tabs for providing hydrodynamic lift to the multihull watercraft when underway, the trim tabs being positioned vertically lower than the port and starboard deflection devices when the multihull watercraft is at rest.

20. The multihull watercraft of claim 1, wherein engagement of one of the port deflection device and the starboard deflection device with water when the watercraft leans to a corresponding one of the port side and the starboard side during turning causes the multihull watercraft to pitch forward and reduce a turning radius thereof toward the corresponding one of the port side and the starboard side.

21. The multihull watercraft of claim 1, wherein the upper tunnel surface is part of at least one of:

the deck; and at least one of the at least three hulls.

22. A multihull watercraft comprising:

a deck;

a port side hull connected to the deck;

a starboard side hull connected to the deck; and a central hull disposed connected to the deck and being disposed between the port side hull and the starboard side hull, the port side hull and the central hull defining a port side tunnel therebetween, the starboard side hull and the central hull defining a starboard side tunnel therebetween;

a port deflection device configured to engage water in response to the multihull watercraft leaning toward the port side when turning, the port deflection device being laterally aligned with the port side tunnel and being disposed at one of:

within the port side tunnel near a rear end of the port side tunnel; and rearwardly of or at the rear end of the port side tunnel; and a starboard deflection device configured to engage water in response to the multihull watercraft leaning toward the starboard side when turning, the starboard deflection device being laterally aligned with the starboard side tunnel and being disposed at one of:

within the starboard side tunnel near a rear end of the starboard side tunnel; and rearwardly of or at the rear end of the starboard side tunnel, each of the port deflection device and the starboard deflection device comprising:

an angled surface extending downwardly and rearwardly from an upper tunnel surface of a corresponding one of the tunnels, the angled surface being positioned to remain above a water line when the multihull watercraft is at rest on water.

* * * * *